United States Patent [19]

McElhaney

[11] Patent Number: 4,968,040

[45] Date of Patent: Nov. 6, 1990

[54] STEP SHAPED DOMINOES

[75] Inventor: Craig J. McElhaney, East Aurora, N.Y.

[73] Assignee: The Quaker Oats Company, Chicago, Ill.

[21] Appl. No.: 394,007

[22] Filed: Aug. 15, 1989

[51] Int. Cl.[5] ..... A63F 7/00

[52] U.S. Cl. ..... 273/294; 273/292; 273/293; 273/290; 446/121; 446/125

[58] Field of Search ..... 273/156, 157 R, 292, 273/293, 294, 275, 290; 446/121, 124, 125

[56] References Cited

U.S. PATENT DOCUMENTS

| | | | |
|---|---|---|---|
| 3,827,695 | 8/1974 | Hess | 273/292 |
| 3,845,574 | 11/1974 | Majewski | 273/293 |
| 4,239,231 | 12/1980 | Henderson | 273/293 |
| 4,285,522 | 8/1981 | Turner | 273/293 |
| 4,381,865 | 5/1983 | de Cubas et al. | 273/294 |

FOREIGN PATENT DOCUMENTS

| | | | |
|---|---|---|---|
| 3409384 | 10/1985 | Fed. Rep. of Germany | 273/294 |
| 0580273 | 11/1924 | France | 273/292 |
| 1330709 | 5/1963 | France | 273/294 |
| 0163103 | 5/1921 | United Kingdom | 273/293 |
| 472119 | 9/1937 | United Kingdom | 446/121 |

OTHER PUBLICATIONS

"Jumbinoes" Advertising Brochure, one sheet.

*Primary Examiner*—Edward M. Coven
*Assistant Examiner*—William M. Pierce
*Attorney, Agent, or Firm*—Cumpston & Shaw

[57] ABSTRACT

A domino type game is provided having game interlocking pieces formed with matching shapes rather than number dot patterns. In accordance with a preferred aspect of this invention, a playing piece is provided that has a stepped configuration with two generally flat engaging portions lying in two spaced apart planes and joined by a web. An upstanding post having a regular shape is mounted on one surface of one engaging portion, and a socket extends through the other engaging portion to the opposite surface. In at least some of the pieces, the shape of the post and the shape of the socket are different, so that a chain of shaped dominoes may be formed as a game.

6 Claims, 4 Drawing Sheets

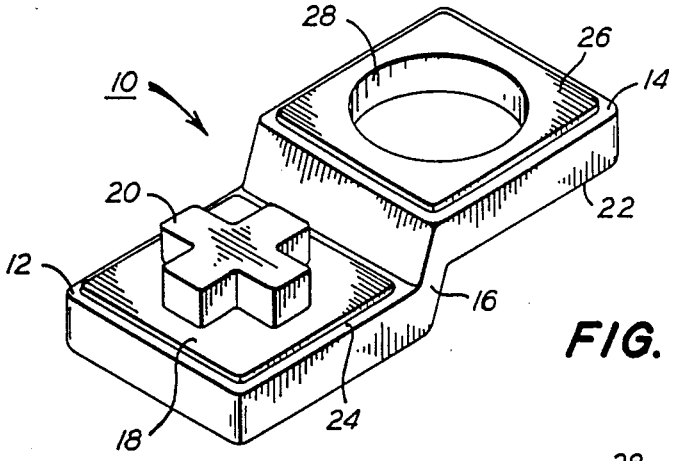
FIG. 1
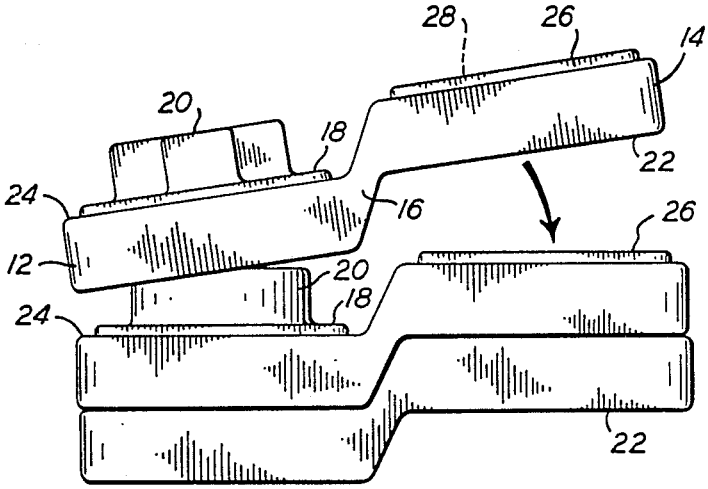
FIG. 2
FIG. 15
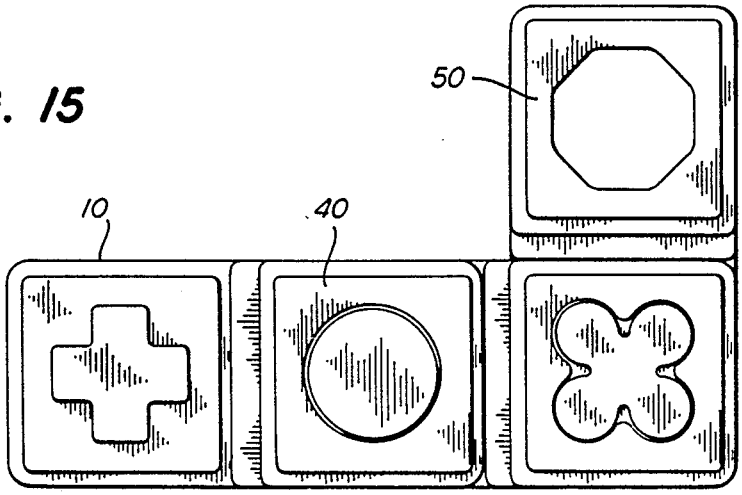

FIG. 3
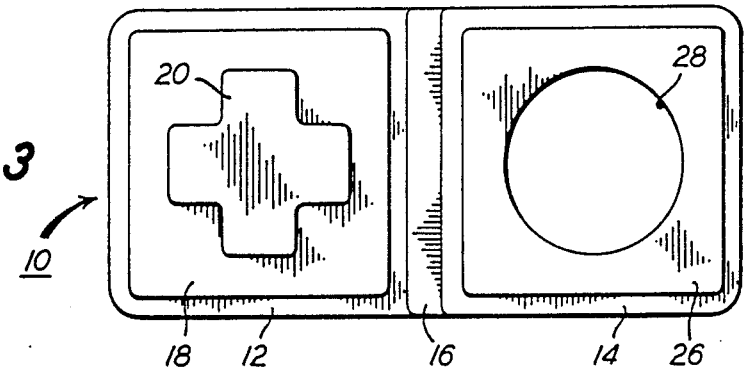
FIG. 4
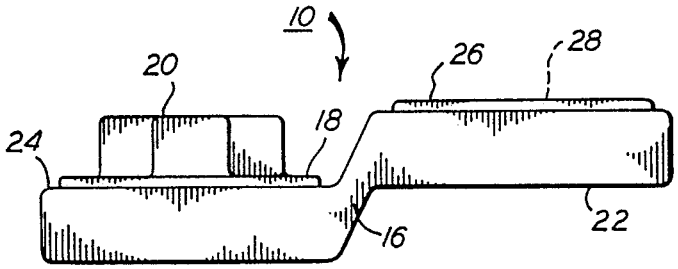
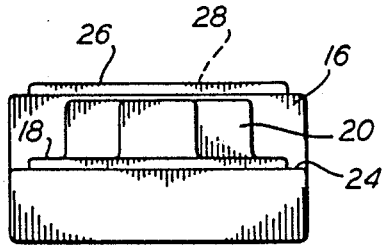
FIG. 5
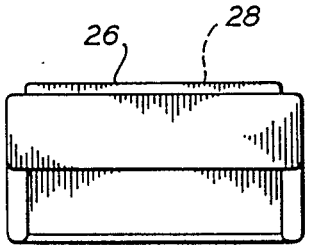
FIG. 6
FIG. 7
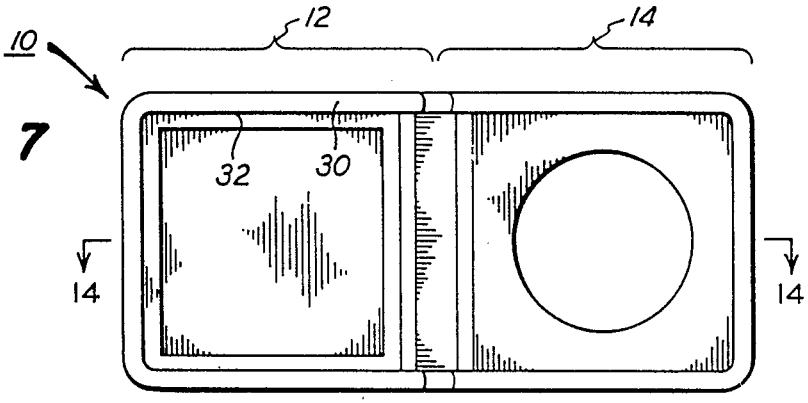

STEP SHAPED DOMINOES

This invention relates in general to children's games, and more particularly to a domino type game for young children, based on the matching of shapes.

Children of all ages enjoy playing domino type games. Conceptually, such games are quite simple. Traditional dominoes involves matching regular patterns of dots formed on opposite ends of a plurality of rectangular blocks. From one to six dots are arranged in consistent patterns on opposite ends, and the domino pieces are arranged end to end, with matching patterns placed adjacent to one another. Although pattern matching is not a particularly complex undertaking, young children cannot easily distinguish among the patterns used on conventional dominoes. The ability to count dots is not acquired until relatively late in early childhood, five years of age or thereabouts. Additionally, young children lack the manual dexterity to place the dominoes next to each other without disturbing those already placed. Accordingly, known dominoe games are largely unsuited for use by young children in their present form.

It is an object of this invention to provide a domino type game that is better suited for play by young children, than those known heretofore.

Briefly stated, in accordance with one aspect of this invention, a domino type game is provided having interlocking game pieces formed with matching shapes rather than number dot patterns. In accordance with a preferred aspect of this invention, a playing piece is provided that has a stepped configuration with two generally flat engaging portions lying in two spaced apart planes and joined by a web. An upstanding post having a regular shape is mounted on one surface of one engaging portion, and a socket extends through the other engaging portion to the opposite surface. In at least some of the pieces, the shape of the post and the shape of the socket are different, so that a chain of shaped dominoes maY be formed as a game.

Preferably, the shapes of the posts and sockets are regular and symmetrical, so that they may be linked either in a straight line, at right angles, or at other angles for forming interesting patterns of domino pieces.

In accordance with a preferred embodiment of the invention, upper and lower flat engaging portions of equal thickness lie in planes separated by the thickness of the engaging portions, so that an array of dominoes can be formed having a height substantially equal to twice the thickness of the engaging portions of the playing pieces.

Shaped dominoes in accordance with this invention extend the classic domino concept to younger children than have heretofore been able to play the game. Children aged three years and up can match shapes and play dominoes with the shape blocks of this invention.

The novel aspects of the invention are set forth with particularity in the appended claims. The invention itself, together with further objects and advantages thereof, may be more readily appreciated by reference to the following detailed description thereof, taken in conjunction with the accompanying drawings in which:

FIG. 1 is a perspective view of an exemplary shape domino in accordance with this invention;

FIG. 2 is a side elevation showing how a plurality of shape dominoes may be stacked for storage;

FIG. 3 is a top plan view of the shape domino of FIG. 1;

FIG. 4 is a right-side elevation of the domino of FIG. 3;

FIG. 5 is a front elevation thereof;

FIG. 6 is a rear elevation thereof; and

FIG. 7 is a simplified bottom plan view thereof.

FIG. 15 is a top plan view of a plurality of shape dominoes according to this invention interlocked in a game configuration.

Figure 8:
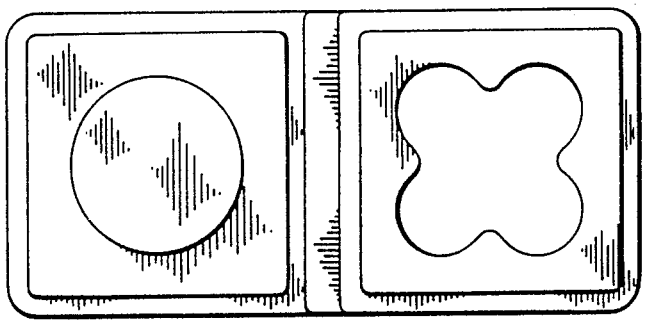
FIGS. 8 through 11 are top plan views of shape dominoes having different shaped pedestals or sockets for forming a set.
Figure 9:
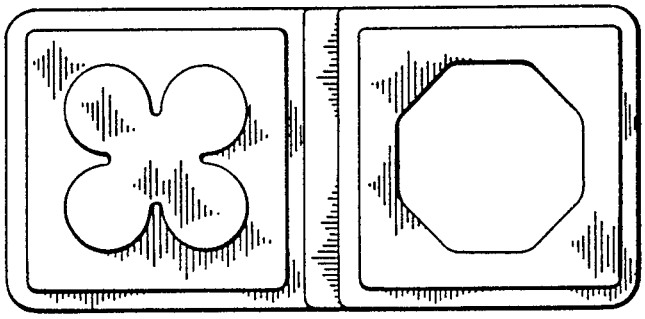
Figure 10:
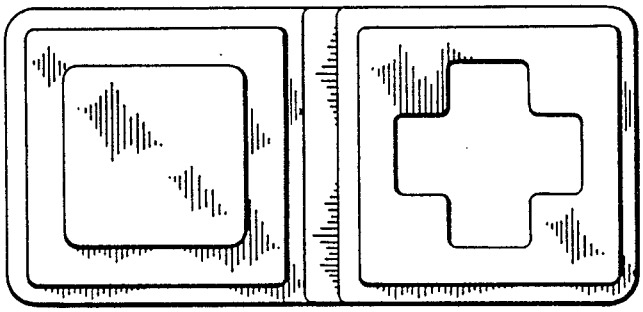
Figure 11:
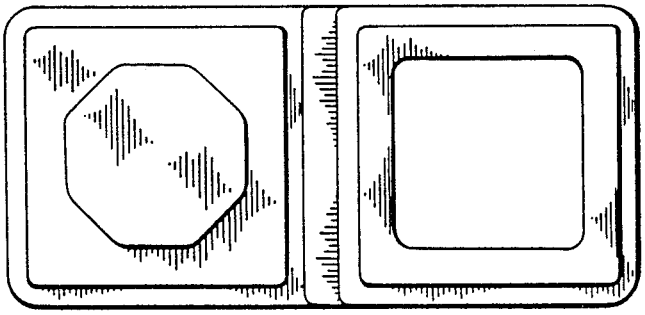

Referring now to FIG. 1, a shape domino in accordance with this invention includes a preferably molded plastic body 10 having two generally flat engaging portions 12 and 14 arranged in staggered relationship, and connected by an inclined web 16. Each of the two engaging lower portions 12 and 14 has a slightly elevated and inset pedestal 18, 26 on an upper surface thereof. An upwardly projecting regularly shaped post 20 in the form of a cross is formed on pedestal 20. As shown in FIGS. 8 through 11, a multiplicity of other shapes is also contemplated for forming a set of shape dominoes for playing a game. All the shapes share the attributes of being regular and symmetrical, so that the shaped dominoes may be interlocked either in a straight-ahead or a right-angle configuration, as shown in the top view at FIG. 31.

While pedestals 18 and 26 are illustrated as generally square, it will be appreciated that other regular shapes may also be employed.

Upper body portion 14 of domino 10 is spaced upwardly from lower body portion 12 by a distance substantially equal to the thickness of lower body portion 12, as may be clearly seen in FIG. 2. Thus the lower edge 22 of upper body portion 14 lies in the same plane as the upper edge 24 of the lower body portion. The upper surface of upper body portion 14 is also provided with a Pedestal 26.

A socket 28 extends from the upper surface of pedestal 26 through upper body portion 14 for receiving a correspondingly shaped post of another shape domino, as will be more clearly seen and described below. The inner peripheral surface of socket 28 matingly engages the outer peripheral surface of corresponding upwardly projecting post 20. The interengagement is illustrated in FIG. 15.

FIGS. 3 through 7 are orthographic views of shape domino 10. FIG. 3 is a top plan view; FIG. 4 a right-side elevation; FIG. 5 a front elevation; FIG. 6 a rear elevation; and FIG. 7 a bottom plan view.

As will be appreciated by particular reference to FIG. 7, the domino includes peripheral side walls 30, the interior edges 32 of which are appropriately sized and shaped to engage the outer peripheral edges of pedestal 24. The portion of the lower body portion 14 underneath pedestal 24 is substantially empty and hollow, and is adapted to receive upwardly projecting post 20, without regard to the shape thereof. Preferably, the post is freely received without engagement of the sides thereof, and accordingly, as shown in FIG. 2, domino pieces may be stacked for storage or for play, without regard to matching the shapes. The structure provides particularly convenient storage.

FIGS. 8 through 11 correspond to FIG. 3, but show a domino having a round post and a shamrock shaped socket; a shamrock shaped post and an octagonal socket; a square post and a cross shaped socket; and an octagonal post and a square socket, respectively.

FIG. 15 shows how dominoes in accordance with this invention are arranged during play. Typically, a first domino 10 would be played by a first player placing it on the surface of a table or on the floor. A second domino 40 having a round socket corresponding to the shape of the round post on the first played domino 10 is placed thereover with the post and socket interengages by a second player either in a linear arrangement or a right angle arrangement, as shown. Subsequently, two or more players alternate turns, placing the sockets of subsequent dominoes 50 over the posts of dominoes already played. Because the sockets extend completely through the upper portion of the domino body, the shapes are readily recognizable from the top and may be matched by children too young to readily match the dot patterns of conventional dominoes.

Figure 12:
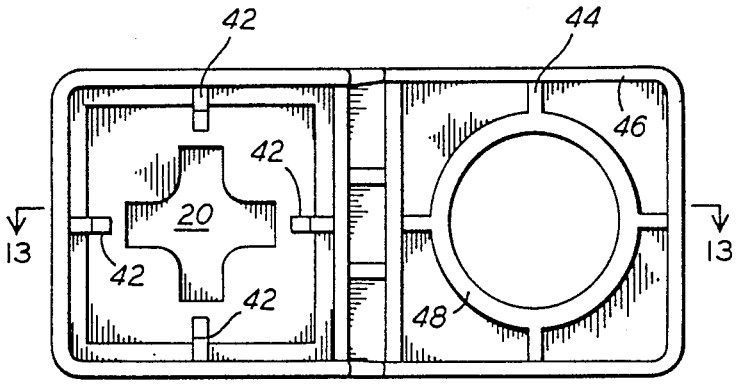
FIG. 12 is a bottom plan view of the shape dominoes of FIG. 1 with molded reinforcing members.
Figure 13:
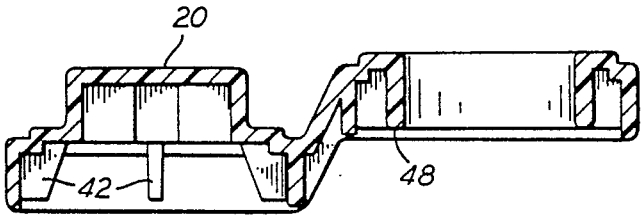
FIG. 13 is a section taken along line A—A of FIG. 8.
Figure 14:
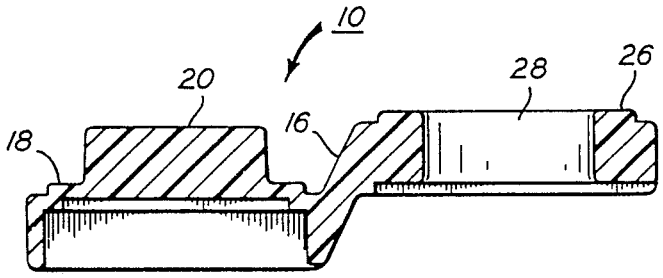
FIG. 14 is a section of a shape domino in accordance with an alternative embodiment of the invention.

Preferably, dominoes in accordance with this invention are formed by molding from plastic. FIG. 12 is a bottom plan view, and FIG. 13 is a cross section of a domino showing the placement of structural members to reinforce the domino piece. Ribs 44 suitably connect the walls 46 and 48 of the domino, without interfering with the interlocking function thereof. Ribs 42 reinforce the post 20 and pedestal 18. Dominoes thus formed may be manufactured inexpensively and efficiently by molding, so as to provide attractive, durable dominoes at low cost. FIG. 14 shows an alternative, simpler structure.

While the invention has been described in connection with a presently preferred embodiment thereof, those skilled in the art will recognize that many modifications and changes may be made therein, without departing from the true spirit and scope of the invention, which accordingly is intended to be defined solely by the appended claims.

What is claimed is:

1. Interlocking step shaped dominoes comprising:

a step shaped domino body having a first engaging portion and a second engaging portion, and a riser connecting the first and second portions;

an upstanding post on a major surface of said first engaging portion;

a post receiving socket extending through a major surface of said second engaging portion;

said post and said socket having different peripheral shapes.

2. The interlocking step shaped dominoes of claim 1 in which said first and second engaging portions have substantially equal thicknesses, and the second engaging portion is offset from the first engaging portion by a distance about equal to the thickness.

3. The interlocking step shaped dominoes of claim 1 further comprising first and second pedestals on said first and second engaging portions respectively, for allowing the dominoes to be stacked.

4. The interlocking step shaped dominoes of claim 1 wherein said domino body comprises a body rectangular in plan view, and in which said first and second engaging portions are staggered in a direction perpendicular to the major surfaces thereof, and said riser comprises an inclined web.

5. The interlocking step shaped dominoes of claim 1 in which said first engaging portion comprises a hollow chamber opening in a direction opposite from the direction in which said post projects for receiving said post and allowing said dominoes to be stacked in completely overlapping relationship.

6. A domino game comprising:

a plurality of domino pieces, each domino piece comprising:

a step shaped domino body having a first engaging portion and a second engaging portion, and a riser connecting the first and second portions;

an upstanding post on a major surface of said first engaging portion;

a post receiving socket extending through a major surface of said second engaging portion;

said post and said socket having different peripheral shapes.

* * * * *